United States Patent [19]

Brussee et al.

[11] 4,128,864

[45] Dec. 5, 1978

[54] SEALED BEAM LAMP UNIT

[75] Inventors: Warren T. Brussee, Warren; William G. Ferris, Chardon, both of Ohio

[73] Assignee: General Electric Company, Schenectady, N.Y.

[21] Appl. No.: 816,432

[22] Filed: Jul. 18, 1977

[51] Int. Cl.[2] ..... F21V 7/00

[52] U.S. Cl. ..... 362/306; 362/80; 362/215; 362/255; 362/336; 362/366

[58] Field of Search ..... 362/61, 80, 83, 215, 362/255, 306, 329, 336, 337, 365, 366, 374

[56] References Cited

U.S. PATENT DOCUMENTS

| | | | |
|---|---|---|---|
| 2,131,828 | 10/1938 | Williamson | 362/306 |
| 2,148,314 | 2/1939 | Wright | 176/34 |
| 2,762,908 | 9/1956 | Gaither | 362/306 |
| 2,782,297 | 2/1957 | Geissbuhler et al. | 362/329 X |
| 2,901,654 | 8/1959 | Myers | 362/306 X |
| 2,907,249 | 10/1959 | Hjermstad | 362/329 X |
| 2,969,162 | 1/1961 | Stutske | 220/2.1 |
| 3,093,324 | 6/1963 | Dobrikin | 362/337 |
| 3,177,356 | 4/1965 | Worden | 362/374 |
| 3,939,337 | 2/1976 | Oda et al. | 362/365 X |

*Primary Examiner*—Peter A. Nelson

*Attorney, Agent, or Firm*—John F. McDevitt; Lawrence R. Kempton; Frank L. Neuhauser

[57] ABSTRACT

An improved pressed glass lens member for a sealed beam lamp unit is provided to include an outer sealing rim of varying thickness to compensate for thermal contraction of the lens member when molded in a predetermined manner. Specifically, the ordinary warped condition encountered with thermal contraction of the pressed glass article when initially formed is compensated for so as to permit subsequent heat sealing with a pressed glass reflector member by thermally fusing the glass material of both members in the sealing regions and without encountering the manufacturing defects now being experienced. The preferred embodiments illustrate such controlled thickness variation of the body section in the outer sealing rim region of a pressed glass lens member for both circular-shaped and rectangular-shaped lens configurations. Additionally, the rectangular-shaped pressed glass lens member embodiment illustrated can further include a molded projection provided on the back sealing surface of the rim region to further reduce unwanted deformation which otherwise occurs when the lens member is initially formed by pressing in glass molds.

12 Claims, 3 Drawing Figures

SEALED BEAM LAMP UNIT

RELATED PATENT APPLICATION

Rectangular-shaped pressed glass sealed beam lamp unit utilizing a molded projection on the back sealing surface of the lens and reflector members is described and claimed in co-pending patent application Ser. No. 750,004, filed Dec. 13, 1976, in the name of Frank Jenne et al., now U.S. Pat. No. 4,076,143, and assigned to the assignee of the present invention.

BACKGROUND OF THE INVENTION

The present invention relates to modification of the lens member component for a sealed beam lamp unit having an inner surface of the lens member component with prism elements to focus light transmitted therethrough and further having an outer sealing rim with front and back sealing surfaces joined by a body section. Said pressed glass sealed beam lamp unit has particular utility for automotive headlights. Circular-shaped headlights having such lens member construction have been used in motor vehicles for some time and can be hermetically sealed without undue difficulty except when the sealing rim of the lens member is warped. This defect is attributable to uneven thermal contraction of the lens members in the mold during initial formation. The front sealing surface of a warped lens member is not flat so as to lie in the same spatial plane and is believed to result from thickness variation of the prism elements on the inner surface of the lens member. Said defect is more frequently encountered on heavily fluted lens members which include rib elements longitudinally extending along the inner surface that tend to cool earlier than the rest of the inner surface. When a circular-shaped pressed glass lens member having a warped sealing rim is thereafter hermetically sealed to the rim of a correspondingly shaped reflector member, it becomes possible to damage the aluminum surface with the gas flames customarily employed to effect hermetic sealing. The gap existing between said sealing surfaces can also produce an unreliable fusion seal.

The more recently introduced rectangular-shaped headlight unit has proven more difficult to fusion seal the individual components together by reason of further deformities produced by uneven thermal contraction when said individual lens and reflector members are initially pressed in glass molds. Thermal contraction of the reflector member customarily produces a convex contour for the front sealing surface of the sealing rim whereas the correspondingly shaped pressed glass lens member usually experiences a mismatching deformation attributable to the rectangular shape of said lens member as well as thickness variation of the prism elements disposed on the inner surface. These mismatching deformities interfere with proper registration of the individual members for hermetic sealing since the deformities can be sufficiently prominent to produce actual bowing of the front sealing surfaces in the rim regions of both glass members. The sealing problem becomes especially severe if such bowing results in a convex deformity in one member while the remaining member has a concave deformity not coincident with the bowing in the other member.

SUMMARY OF THE INVENTION

It has now been discovered, surprisingly, that undesirable deformation of the lens member component for a pressed glass sealed beam unit can be compensated for in a particular manner avoiding the difficulties above pointed out. Deformation can be avoided for a circular-shaped pressed glass lens member by varying the thickness of the rim body section to compensate for thermal contraction during molding so that the front sealing surface of the molded article lies in the same plane. Thickness variation of said body section in the rim region of a rectangular-shaped pressed glass lens member also compensates for thermal contraction during molding in a predetermined manner but produces a concave contour at the front sealing surface of the sealing rim. Such contour provides better correspondence with the convex contour of the front sealing surface on the reflector member for hermetic sealing thereto.

In a preferred embodiment for the present rectangular-shaped pressed glass lens member, undesired deformation in the sealing rim region is further controlled with projections located on the back sealing surface intermediate the inner and outer rim edges as described in the aforementioned copending application Ser. No. 750,004. Said projection elements also control thermal contraction in the sealing region during molding by restraining the glass from sagging with mold indentations. Remote location of such restraining elements does not interfere with the subsequent heat-sealing operation when the sealed beam lamp unit is subsequently assembled.

DESCRIPTION OF THE PREFERRED EMBODIMENTS

Figure 1:
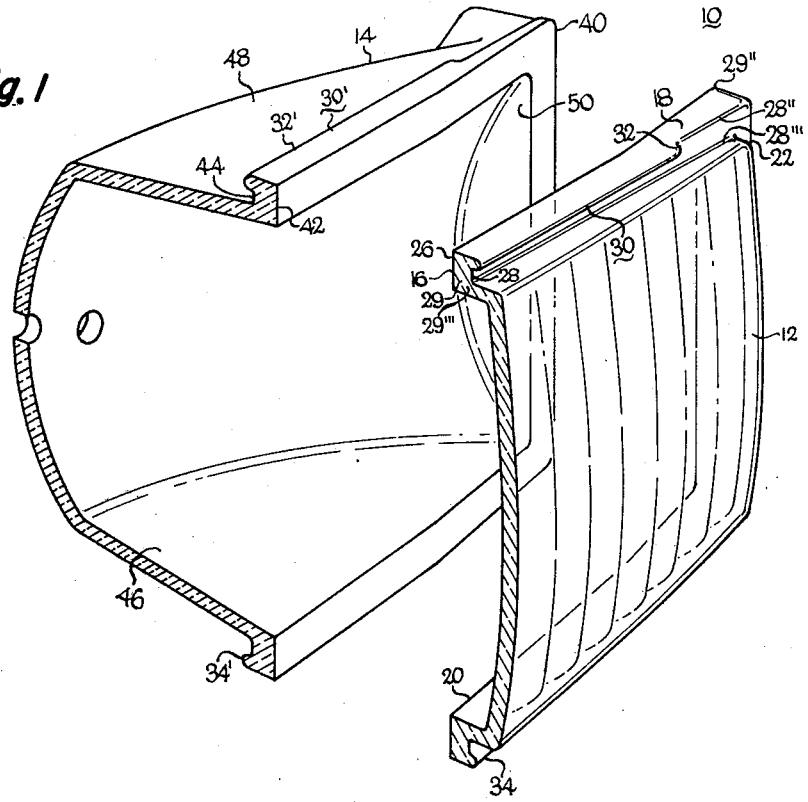
FIG. 1 is a perspective view partially in cross section of an improved rectangular-shaped pressed glass sealed beam lamp unit of the present invention prior to heat sealing.

Referring to the drawings, in FIG. 1 there is shown a preferred embodiment for a rectangular-shaped sealed beam lamp unit 10 which includes a rectangular-shaped glass member 12 and a rectangular-shaped pressed glass reflector member 14 prior to heat sealing together. The glass member 12 includes a sealing rim 16 having a rectangular shape defined by longer opposing sides 18 and 20 which are joined by shorter opposing sides 22 and 24 (see FIG. 3 as well as FIG. 1). The sealing rim 16 further includes front and back sealing surfaces 26 and 28, respectively, and with the rim edges of said back sealing surface further including outer rim edge 28″ and inner rim edge 28‴. The body section 29 of said sealing rim 16 is further shown to have a greater thickness 29″ on the shorter sides 22 and 24 of the lens member than the glass thickness 29‴ on the longer sides 18 and 20 of the lens member. As can further be noted in FIGS. 1 and 3, the back sealing surface 28 further includes a molded segment projection 30 in the form of a plurality of oppositely disposed elements 32, 34, 36 and 38. The pair of projection elements 32 and 34 which are longitudinally disposed on the longer sides of the rectangular-shaped member are of approximately equal length greater than the length of the approximately equal length elements 36 and 38 which are disposed on the shorter sides of said lens member. Of still further consideration in said embodiment as depicted in FIG. 1, it can be noted that front sealing surface 26 has a concave contour attributable to the greater glass thickness 29″ of said sealing rim 16 for the shorter sides of the lens member than the glass thickness 29‴ on the longer sides.

Correspondingly, the rectangular-shaped reflector member 14 in FIG. 1 includes a sealing rim region 40 having a front sealing surface 42 and a back sealing surface 44 as well as a generally parallel relationship between the major sides of said member. The parallel relationship existing between the major sides 46 and 48 making up the longer sides of said rectangular construction is shown along with one of the shorter sides 50 which intersects with said major longer sides. It can also be noted that front sealing surface 42 defines a convex contour resulting from deformation when the glass member is initially pressed. Said convex contour closely approximates the concave contour of the front sealing surface 26 of lens member 12 as modified in accordance with the present invention. The back sealing surface 44 of said pressed glass reflector member further includes the same type segmented molded projection 30′ as has been previously described for the pressed glass lens member 12. Thus, rib elements 32′ and 34′ comprise a pair of oppositely disposed projection elements having approximately equal length longer than a second pair of oppositely disposed elements (not shown) located on the shorter sides of the rectangular-shaped reflector member 14. The extent of thickness variation in the rim body section of the lens member above described to provide the desired final contour can be illustrated for a conventional size 6½ inches nominal length by 3⅛ inches nominal width automotive headlight. Accordingly, the sealing rim thickness for the longer sides of said member is maintained in the range 0.180–0.185 inch thickness and the rim thickness on the shorter sides is maintained in the range 0.190–0.200 inch thickness.

Figure 2:
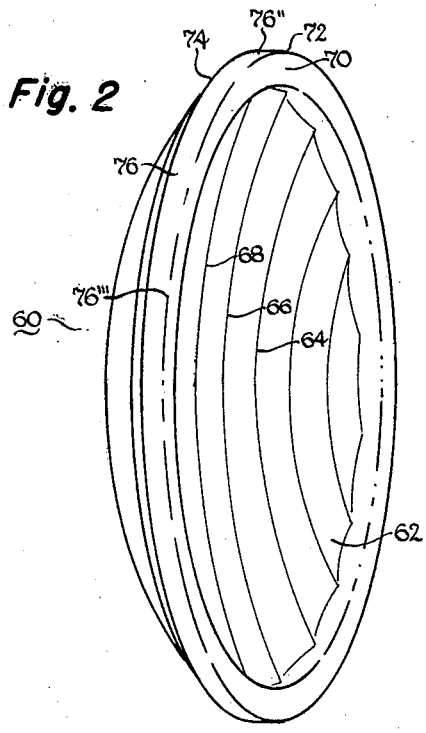
FIG. 2 is a perspective view of an improved circular-shaped pressed glass lens member according to the present invention.

In FIG. 2 there is shown a circular-shaped pressed glass lens member 60 for a sealed beam lamp unit which includes inner surface 62 having representative prism elements 64, 66 and 68 along with outer sealing rim 70 with front and back sealing surfaces 72 and 74, respectively. The sealing rim further includes a body section 76 having a greater thickness 76″ than the glass thickness 76‴ in a transverse direction. As can be noted, the thickness of the rim body section is greater in the direction of said longitudinally extending rims than in the transverse direction thereto. As a result of such thickness variation in the body section of said lens member 60, it is possible to compensate for thermal contraction of the lens member when initially molded so that the front sealing surface 70 of the final member lies in the same spatial plane. To further illustrate the degree of thickness variation needed to provide this result for a 4½ inch nominal diameter size automotive-type headlight, the body section thickness 76″ of said lens member is maintained in the range 0.160–0.165 inch thickness whereas the body section thickness 76‴ in a direction transverse thereto is maintained in the range 0.150–0.155 inch thickness. Hermetic sealing together of this lens member with a conventional glass reflector member of comparable size and shape but having an outer sealing rim of uniform thickness fuses the glass material in the rim regions of both members to provide a more reliable seal.

Figure 3:
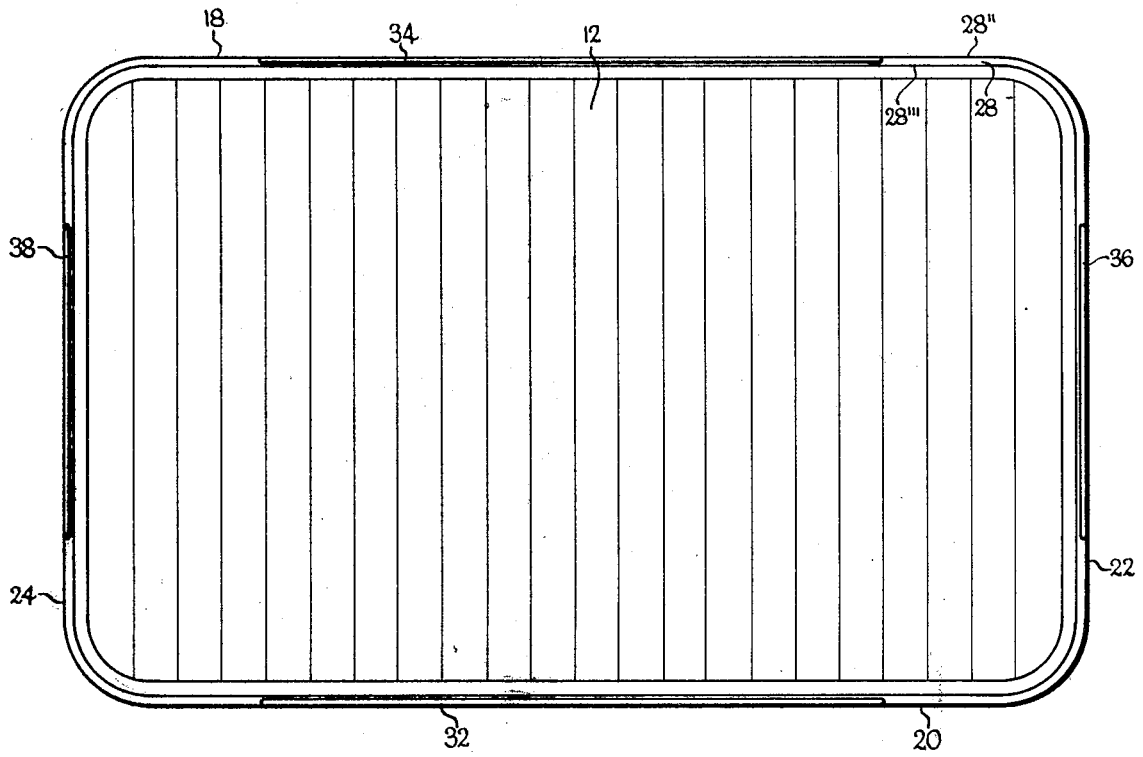
FIG. 3 is a plan view of a further modified rectangular-shaped lens member construction according to the present invention.

A modification of the rectangular-shaped lens member described in FIG. 1 is depicted in FIG. 3. Accordingly, the same numerical designation previously used for identification of component parts will be retained in describing comparable elements in FIG. 3. The modified pressed glass lens member 12 has a first pair of longer length projection elements 32 and 34 disposed on the longer sides 18 and 20 of said modified lens member along with the second pair of shorter elements 36 and 38 being disposed on the shorter sides 22 and 24 of said modified lens member. As can be noted with respect to the disposition of all said projection elements on the back sealing surface 28 of said modified member, each element lies inwardly of both the outer rim edge 28″ as well as the inner rim edge 28‴ which is distinct from the FIG. 1 embodiment wherein all of the molded projections proceed rearwardly from the outer rim edge. Hermetic sealing together of said modified lens member having a thickness variation (not shown) of the rim body section as previously described in connection with said FIG. 1 embodiment with a comparable size and shape reflector member fuses the glass material at the front sealing surfaces of both members to such an extent that all projection elements 32, 34, 36 and 38 disappear. A more reliable hermetic seal is obtained in this manner than is generally possible when utilizing either the projection elements alone or by varying the sealing rim thickness of the lens member without further employing said projection elements.

It will be apparent from the foregoing description that a generally improved lens member construction has been provided for a pressed glass sealed beam lamp unit. It will be apparent that modifications can be made in the specific shape or rim thickness variation of a particular lens member other than above specifically described without departing from the true spirit and scope of this invention. For example, it is within the present contemplation to provide a circular-shaped sealed beam lamp unit which does not utilize projection elements disposed on the back sealing surface of the sealing rim. Consequently, it is intended to limit the present invention only by the scope of the appended claims.

What we claim as new and desire to secure by United States Letters Patent is:

1. A pressed glass lens member for a sealed beam lamp unit which include an inner surface having prism elements to focus light transmitted therethrough including longitudinally extending ribs and an outer sealing rim having front and back sealing surfaces joined by a body section wherein the improvement comprises varying the thickness of said body section so that the thickness of said rim body section is greater in the direction of said longitudinally extending ribs for a circular shaped lens member while the thickness of said rim body section is greater in a direction transverse to the direction of said longitudinally extending ribs for a rectangular shaped lens member.

2. A circular-shaped glass lens member as in claim 1 wherein the front sealing surface of said sealing rim lies in the same plane.

3. A rectangular-shaped pressed glass lens member as in claim 1 wherein the thickness of the rim body section is greater on the shorter sides of the glass lens than the thickness on the longer sides of the glass lens.

4. A rectangular-shaped pressed glass lens member as in claim 3 wherein the front sealing surface of said sealing rim has a concave contour attributable to thickness variation of the rim body section.

5. A rectangular-shaped pressed glass lens member as in claim 3 which further includes a longitudinally extending molded projection disposed on the back sealing surface of said sealing rim.

6. A rectangular-shaped pressed glass lens member as in claim 5 wherein said molded projection lies intermediate the inner and outer edges.

7. A rectangular-shaped pressed glass lens member as in claim 5 wherein the molded projection comprises a plurality of oppositely disposed projection elements in the form of two pair of unequal length elements and with the pair of said elements disposed on the longer sides of the lens member being of approximately equal length greater than the length of the approximately equal length pair of elements disposed on the shorter side of said lens member.

8. A pressed glass sealed beam lamp unit which includes a lens member with an inner surface having prism elements including longitudinally extending ribs to focus light transmission therethrough and an outer sealing rim having front and back sealing surfaces joined by a body section of varying thickness that has been hermetically sealed to an outer sealing rim of a pressed glass reflector member, so that the thickness of said rim body section is greater in the direction of said longitudinally extending ribs for a circular shaped lens member while the thickness of said rim body section is greater in a direction transverse to the direction of said longitudinally extending ribs for a rectangular shaped lens member.

9. A pressed glass sealed beam lamp unit as in claim 8 having a rectangular shape and wherein the thickness of the rim body section for said lens member is greater on the shorter sides of the lens member than the thickness on the longer sides of said lens member.

10. A rectangular-shaped pressed glass sealed beam lamp unit as in claim 9 wherein the front sealing surface of the sealing rim for said lens member has a concave contour attributable to thickness variation of the rim body section for said lens member and which concave contour matches a convex contour for the sealing rim of the pressed glass reflector member.

11. A rectangular-shaped pressed glass sealed beam lamp unit as in claim 10 which further includes a longitudinally extending molded projection disposed on the back sealing surfaces of the outer sealing rims of both pressed glass members and wherein the hermetic sealing together at the front sealing surfaces of said members fuses the glass material so that said projections have disappeared.

12. A rectangular-shaped pressed glass sealed beam lamp unit as in claim 11 wherein the molded projections disposed on both pressed glass members each comprise a plurality of oppositely disposed projection elements in the form of two pair of unequal length elements and with the pair of said elements disposed on the longer sides of said members being of approximately equal length greater than the length of the approximately equal length pair of elements disposed on the shorter sides of said members.

* * * * *